United States Patent [19]

Pacini

[11] 4,226,223

[45] Oct. 7, 1980

[54] MACHINE FOR SAWING BLOCKS OF SOLID, ESPECIALLY STONY MATERIALS, SUCH AS MARBLE, GRANITE AND THE LIKE

[76] Inventor: Ermanno Pacini, Via R. De Grada 3, Milan, Italy

[21] Appl. No.: 962,658

[22] Filed: Nov. 21, 1978

[30] Foreign Application Priority Data

Dec. 1, 1977 [IT] Italy ..... 30282 A/77

[51] Int. Cl.[3] ..... B28D 1/06

[52] U.S. Cl. ..... 125/16 R; 125/19

[58] Field of Search ..... 125/12, 16 R, 16 L, 125/16, 17, 19; 30/393

[56] References Cited

U.S. PATENT DOCUMENTS

| | | | |
|---|---|---|---|
| 2,554,678 | 5/1951 | Minkler | 125/19 |
| 2,781,800 | 2/1957 | Papworth | 30/393 |
| 2,961,016 | 11/1960 | Papworth | 30/393 |

FOREIGN PATENT DOCUMENTS

| | | | |
|---|---|---|---|
| 449904 | of 1949 | Italy | 125/16 R |
| 489542 | of 1954 | Italy | 125/16 R |
| 566367 | of 1957 | Italy | 125/16 |

*Primary Examiner*—Harold D. Whitehead

*Attorney, Agent, or Firm*—Charles E. Brown

[57] ABSTRACT

A machine for sawing stones, of the kind having one or more reciprocable blade-carrying frames, is disclosed, wherein an actuating mechanism for said blade-carrying frame is provided, which moves said frame(s) substantially parallel to itself along a preselected elliptical path. A few embodiments of the machine are disclosed: one of these presents quite particular an approach by which the stresses on the pivotal and connection pins are considerably reduced by exploiting appropriate balancing contrivances, such as counterweights located at appropriate points of the specially provided balancing connecting rods. A longer service life is thus provided both to the blades and the machine as a whole.

5 Claims, 14 Drawing Figures

4
III
12
16
5
13
6
6
6
6
1
21
11
14
17
10
16
1
12
22
22
22
22
3
13
18
19
20
19
18
11
14
2
17
26
10
24
25
III

MACHINE FOR SAWING BLOCKS OF SOLID, ESPECIALLY STONY MATERIALS, SUCH AS MARBLE, GRANITE AND THE LIKE

This invention relates to a machine for sawing blocks of a solid material, especially a stony material, such as marble, granite and the like.

In order to obtain slabs from blocks of stony material sawing machines are used at present, which, consistently with the size expected for such slabs, use frames with diamond-lined blades to which a reciprocal motion is imparted along a straight line, or mills are employed having disks of various diameters.

Both the blades and the disks have a set of diamond inserted teeth, in which small diamonds are held together by an appropriate binder to form the so-called "diamond concretion".

Inasmuch as the diamond is the hardest naturally occurring material, the individual granules which project from the binder, when properly pressed against the material to be sawed, penetrate the same with a comparatively high ease and, by virtue of the tool motion, scratch a plurality of tiny furrows which, together, originate the sawing action.

This phenomenon occurs both with the blades and the discs but with these latter a chiseling action is added, which is effected not only by the individual diamond granules impinging onto the top surface of the stony material block, but also by the tooth abutting a formed by the advance of the disk in the cutting direction in the time interval concerned, which time is equal to the distance between the diamond-lined sectors divided by their peripheral speed.

To state that the sawing action with disks is, up to a certain percentage, a function of the chiseling action is, perhaps, questionable, but it can be surmised that, with cutting depths of a few millimeters, it will have a prevailing effect, whereas, with thick thicknesses and attendant long teeth runs on the material to be sawed, abrasion will play the leading role.

A disk is capable, under particular conditions, of sawing as much as 6,000 square centimeters per minute, while a blade seldom attains one tenth as much. Also in connection with the material sawed by the same amount of diamond concretion, the efficiency of the disk overrules that of a blade.

It cannot be overlooked, on the other hand, that the blade has over the disk the advantage of being capable in sawing slabs of 1.80 to 2.0 meters of height with a steel core of 3 millimeters in thickness and teeth or diamond coated sectors of 5 millimeters. Still with a diamond-lined disk of 625 millimeters, which is capable of sawing a maxium height of 22 centimeters, a core of 3.5 millimeters is required and teeth of 5.5 millimeters, not to speak of the core and the teeth, which are of 9 and 12 millimeters, respectively, which are required for a disk having a diameter of 2,700 millimeters, as compared to a saw with a maximum depth of 105 centimeters.

A thicker core and thicker teeth mean, as it is apparent, a higher tool cost, a higher power usage, an increased waste of material to obtain the same square meters, the whole being accompanied by an increased production of sludges, and so forth.

As an alternative suggestion to replace the sawing machines as tendered at present by the market, U.S. Pat. No. 2,554,678 discloses a machine which acts to saw blocks of a stony material by using a set of blades having diamond lined teeth which are held in a taut position by a frame or a cornice to carry the blades, which is, in its turn, eccentrically fastened at its ends to a couple of wheels having discordant motions which impress to the blades reciprocal motions with an inverted slope which is variable continuously, so that elliptical motions are produced for the individual teeth, the axial ratio being decreased from the centre to the periphery of the blades.

Such a machine has the principal defect that, by virtue of the translational motion with variable slope to which the blades are subjected, the teeth of the individual blades are compelled to work in an uneven manner, since the central teeth are constantly in engagement with the block of the material to be sawed, whereas the side teeth operate on the respective halves of the block in the only occasion of to and fro strokes of the blades to which they belong.

This fact, as is apparent, is conducive to an uneven wear of the teeth, which will remain operative at the periphery but virtually worn out at the centre. It should also be considered that, just because the central teeth are constantly in engagement, a possible deviation of the teeth from the desired cutting position cannot be corrected in any way. On the other hand, inasmuch as the ratio of the major axes to the minor axes of the elliptic routes of the teeth decreases from the centre towards the periphery of the blades and decreases substantially to one, the efficient, that is, abrading route also decreases from the centre to the periphery, the result being that the blades will have a good abrasive power at their centre but the abrasive power will be poor at the periphery. From this fact, as it is obvious, stems an efficiency of the machine which is far from optimum. In addition, it becomes virtually impossible to preselect any desired degree of chiseling.

An object of the present invention is to provide, particularly but not exclusively for stony materials, a sawing machine which, within the limits of practicability, combines the technical assets of the present blade frames and those of the disk mills without suffering from the defects of neither and which, concurrently, even exploiting in part the basic idea of the above mentioned U.S. Pat. No. 2,554,678, introduces in it such conceptual modifications as to overcome all the drawbacks enumerated in the foregoing.

According to the invention this object is achieved by means of a sawing machine of the kind comprising a movable supporting frame for a plurality of parallel toothed blades, characterized in that it comprises means for actuating said blade-carrying frame, said means being adapted to move said frame substantially sequentially into a plurality of parallel positions where said frame always remains in the same alignment but is shifted both transversely and longitudinally while remaining what may be considered parallel to itself along a preselected substantially elliptical raceway.

Said actuating means are preferably formed, on each side of the blade-carrying frame, by a couple of wheels having a concordant rotary motion, with there being attached to each of the wheels for rotation either end of a respective connecting rod, the other end of which is attached for rotation to a slider having a rectilinear motion directed parallel to the connecting line of the rotation axes of the two wheels, said connecting rods having substantially the same length and carrying said side of the blade-carrying frame attached for rotation to points which are similarly arranged with respect to the connecting rod ends, so that the associated side is, and remains, parallel to said connecting line of the rotation axes of said wheels.

The sawing machine according to the invention is thus of the kind having a blade-carrying frame, but differs from those of the same kind as marketed nowadays, such as that described in the abovementioned U.S. Pat. No. 2,554,678 for the different type of motion to which the blade-carrying frame is subjected. According to this invention, the blade-carrying frame, in fact, is driven parallel to itself along a preselected elliptic raceway which is thus exactly the same for all the teeth of each individual blade, whereas the blade-carrying frame of the present machine is driven along a run which is rigorously rectilinear and that of the U.S. patent aforesaid is subjected to a combined to-and fro motion and of alternate inclination which causes the individual teeth to go along elliptic routes of different shapes, which are elongate to a decreasing degree from the centre to the periphery of the blades.

As a result, the blades of the sawing machine of this invention alternate forward strokes in which their teeth are all in an equal processing engagement with the material to be sawed with return strokes in which all the teeth are brought away from the material concerned.

These circumstances provide a number of advantages which, relative to the most usual exploitation for stony materials and as compared with the present frames with diamond-lined blades, as follows:

(a) the speed of displacement of the blades can be increased considerably, up to a value near that (20 meters/second) as suggested by the Italian Association of the manufacturers, merchants and sales agents of diamond-lined tools in their technical specification for 1977, for sawing disks of granite having a high contents of quartz. This is a result of the fact that, working with the blades only in connection with either of the two reciprocations to which they are subjected, a lesser tension of the blades is sufficient and this fact permits, in turn to have a reduced weight of the blade carrier frame and in addition the inertial force of the frame in the above mentioned preferred case in which each side of the blade carrier frame is attached for rotation to a couple of connecting rods by a corresponding couple of pivots, is distributed over more pins, each of which is subjected to a comparatively reduced load.

(b) Inasmuch as there are no reversals of motion of the teeth during their travel over the material to be sawed, there is no initial friction at every dead centre of the motion of the blade frames such as experienced in the present art.

(c) In the sawing machine according to the invention, when used with diamond lined teeth for sawing stony materials, the single direction of motion of the teeth during the working stages acts in such a way that each individual diamond protects from wear its upstream binder and thus provides a resting shoulder. This fact is not experienced with the present frames with diamond-lined blades, in which the working motion has two directions so that it may occur that a small diamond piece is ejected prematurely from its bed: to retard this phenomenon which obviously shortens the service life of the tool, diamond mowders must be used, which have particular properties and which are more expensive.

(d) The discontinuous contact of the teeth permits the performance of that chiselling action which is deemed essential in the case of sawing with shallows passes with disks, as it occurs with granite.

(e) After each effective stroke all the diamond-lined teeth of the machine are brought away of the material so that the blades, if they have undergone deviations during the contact phase, have both the opportunity and the time for being straightened and to orient themselves in a position which is exactly perpendicular relative to the block in the subsequent processing stage. This is obviously impossible to obtain in the present reciprocated blades and is difficult in the case of the disks, since there is always a certain percentage of teeth (from 5% to 20%), which, at any rate, still remains in contact with the material to be sawed. If one bears in mind the difficulty and the costs of the processing stages which are required for offsetting the defects due to deviations, more particularly with granite slabs, it will be understood what importance may have this particular feature of the sawing machine of the invention.

(f) Washing the diamond-lined teeth or sectors becomes especially significant when sawing materials such as basaltine, peperin and sandstones in general, which forms a highly abrasive sludge. It is to be noted, moreover, that washing is the more efficient the more intensive is the withdrawal of the teeth from the cutting line and this withdrawal, in the sawing machine according to the invention, is a function of the distance which has been selected between the point of attachment of the frame to every individual connecting rod and the point of attachment of the connecting rod to the respective slider. The foregoing is an evidence that the sawing machine according to the invention is particularly suitable for sawing abrasive materials.

The sawing machine according to the invention has thus a host of positive features as compared with the present frames for diamond-lined blades, to the class of which it belongs and of which it retains all the well known advantages over the disk mills.

There are specific advantages of the machine in question over the machine disclosed in the U.S. Pat. No. 2,554,678. The principal of them can be resumed as follows:

(a) Inasmuch as the blades are moved so as to remain constantly parallel to themselves, all the teeth operate in the same way so that they are worn in the same way, too. The service life of the blades as a whole is thus considerably improved.

(b) All the teeth remain in engagement with the material during the entire working stroke but are disengaged during the return stroke, so that the correction of small deviations becomes practicable.

(c) Still as a result of the removal of the teeth from the material during the return strokes, it become possible to wash the teeth adequately so that the use of the machine for sawing abrasive materials is also possible.

(d) All the teeth of all blades travel along elliptical routes which are equal to each other. This fact, on the one hand, imparts to all of the teeth the same abrasive power and, on the other hand, permits to preselect any desired chiselling intensity.

The principal problem to be solved in the practical embodiments of the machine in question is, conversely, that of the work speed: it is desired, in fact, that such a speed is the highest possible but in any case compatible with the requirement of limiting the stresses on the pins, especially in the dead centres at which the direction of motion is reversed.

Having this problem in mind, a possible embodiment of the machine according to the invention preferably provides that, in the exemplified case of actuating means composed by couples of wheels having a concordant motion and supporting connecting rods for the blade-carrying frame, there is, as an addition for each couple of wheels, a connecting rod having its ends pivoted to said wheels at points which are both diametrically and axially opposite to one another relative to the pivotal points of the supporting connecting rods.

The function of the two additional connecting rods is to afford an appropriate balance of the weight of the blade-carrying frame, so as to counteract the stresses thereof and to permit that such a frame, and thus the entire sawing machine, to attain an improved working speed. Of course, these additional connecting rods must be appropriately sized and, to this purpose, it is preferred that means be provided to attach to the main body of each connecting rod appropriate additional weights which permit one to adapt the balancing weight of the rods to that of the blade-carrying frame, the latter being varied consistently with the number of blades carried thereby.

According to a further embodiment, the machine according to the invention provides, conversely, a solution of the same problem by equipping each wheel with a balancing connecting rod which is wholly equal to that for supporting the blade-carrying frame, and has either end pivoted to said wheel at a point which is diametrically and axially opposite to pivotal point of either end of the supporting connecting rod, the other end of said balancing connecting rod being reciprocable in the same direction but in opposite sense relative to the other end of the supporting connecting rod, said balancing connecting rod being equipped with a counterweight equal to one fourth of the weight of the blade-carrying frame and attached to the balancing connecting rod at a point situated at a distance, from the other end of the balancing connecting rod, which is equal to the distance between the point of attachment of the blade-carrying frame and the other end of the supporting connecting rod aforesaid.

By adopting such an arrangement, the two masses attached to the same control wheel are arranged and moved exactly in the same way, so that the forces in play are constantly balanced both in the vertical and the horizontal directions. The resultant stresses are extremely reduced and, as it is apparent, this fact permits to attain higher speeds.

The features and advantages of the present invention will better be understood from the ensuing detailed description of a few possible embodiments thereof which are illustrated by way of non-limiting examples in the accompanying drawings, wherein.

Figure 11:
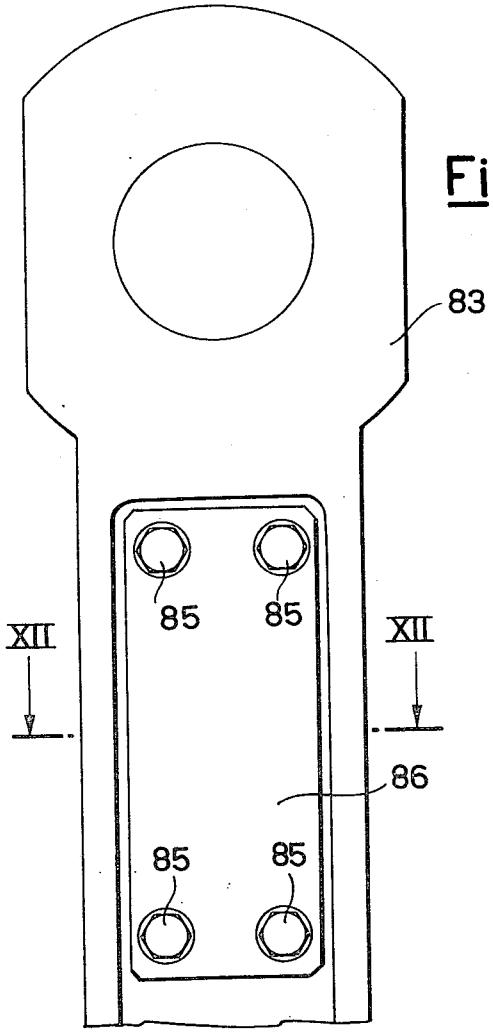

FIG. 11 an enlarged front view of the top portion of the connecting rod which unites the two wheels of the aforesaid unit.

Figure 12:
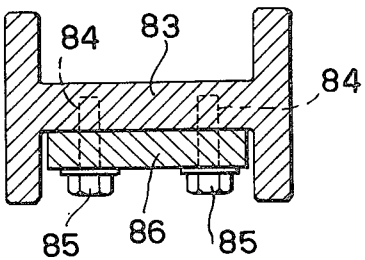

FIG. 12 is a cross-sectional view of the connecting rod taken along the line XII—XII of FIG. 11.

Figure 13:
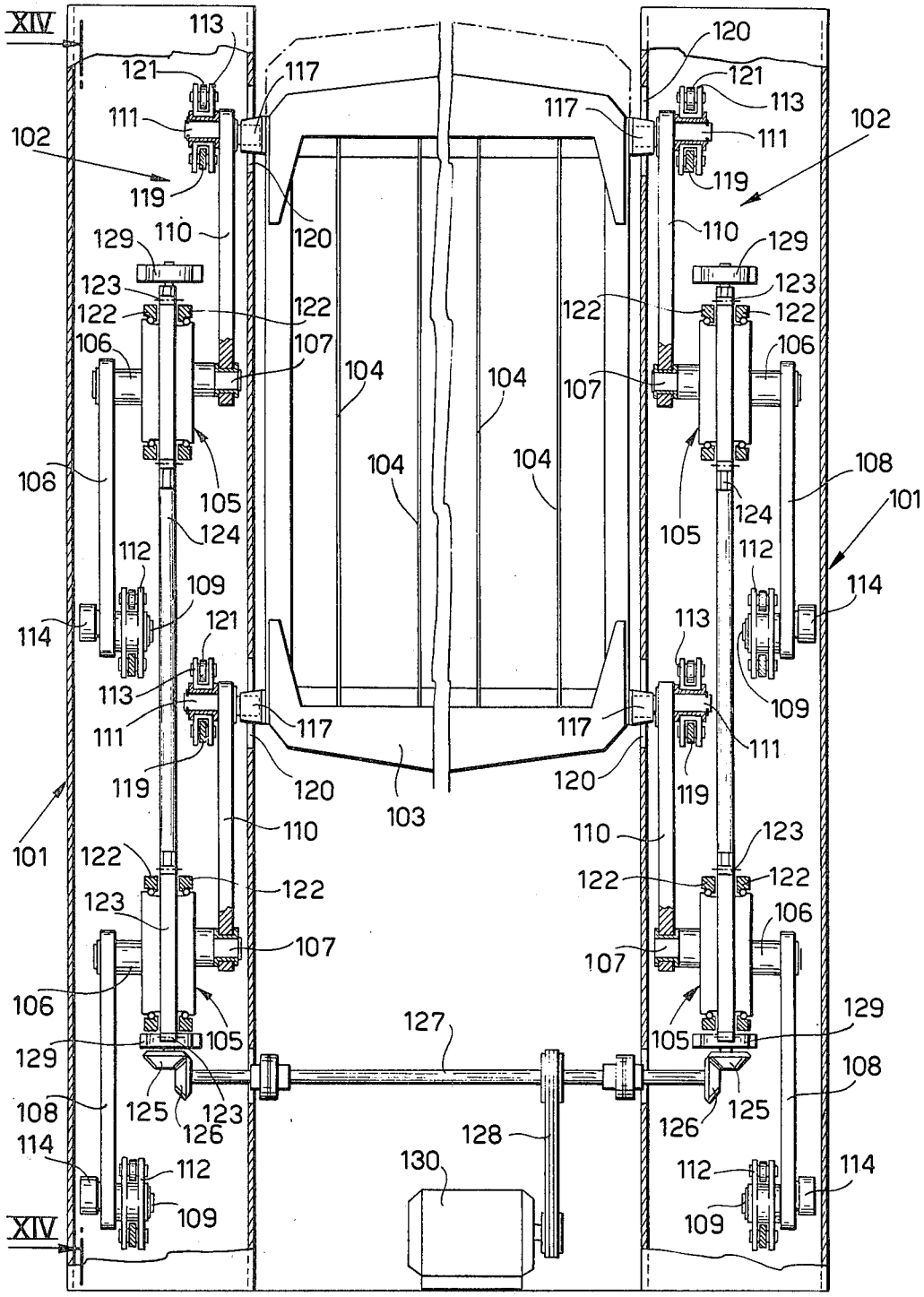
Figure 14:
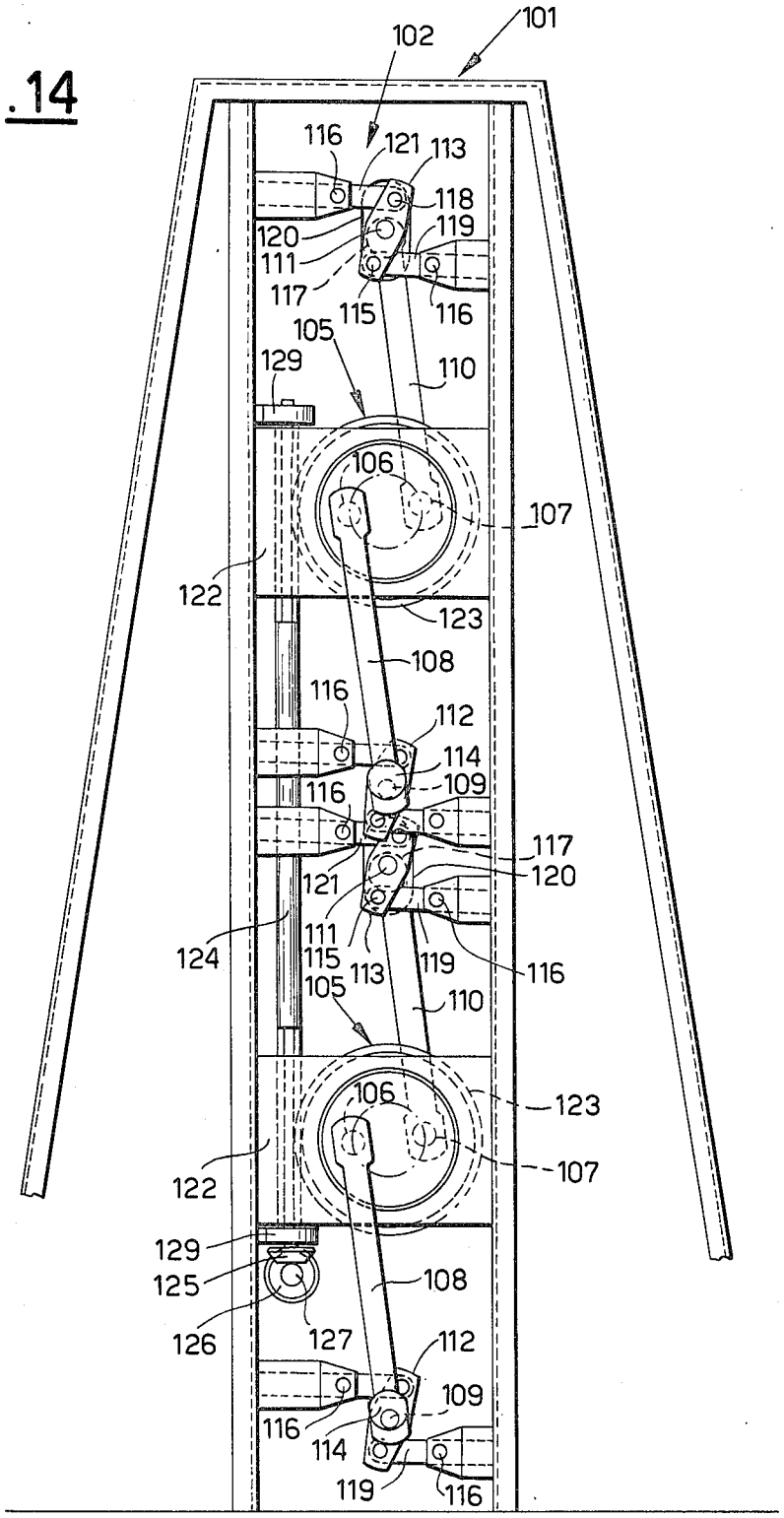

FIG. 13 is an elevational view, partly in cross-section, of a third machine according to the present invention, which is equipped with balancing connecting rods as explained hereinbefore, and FIG. 14 is a side view taken along the line XIV—XIV of FIG. 13, of one of the two actuation units for the blade-carrying frame which is an integral part of the machine aforementioned.

Figure 1:
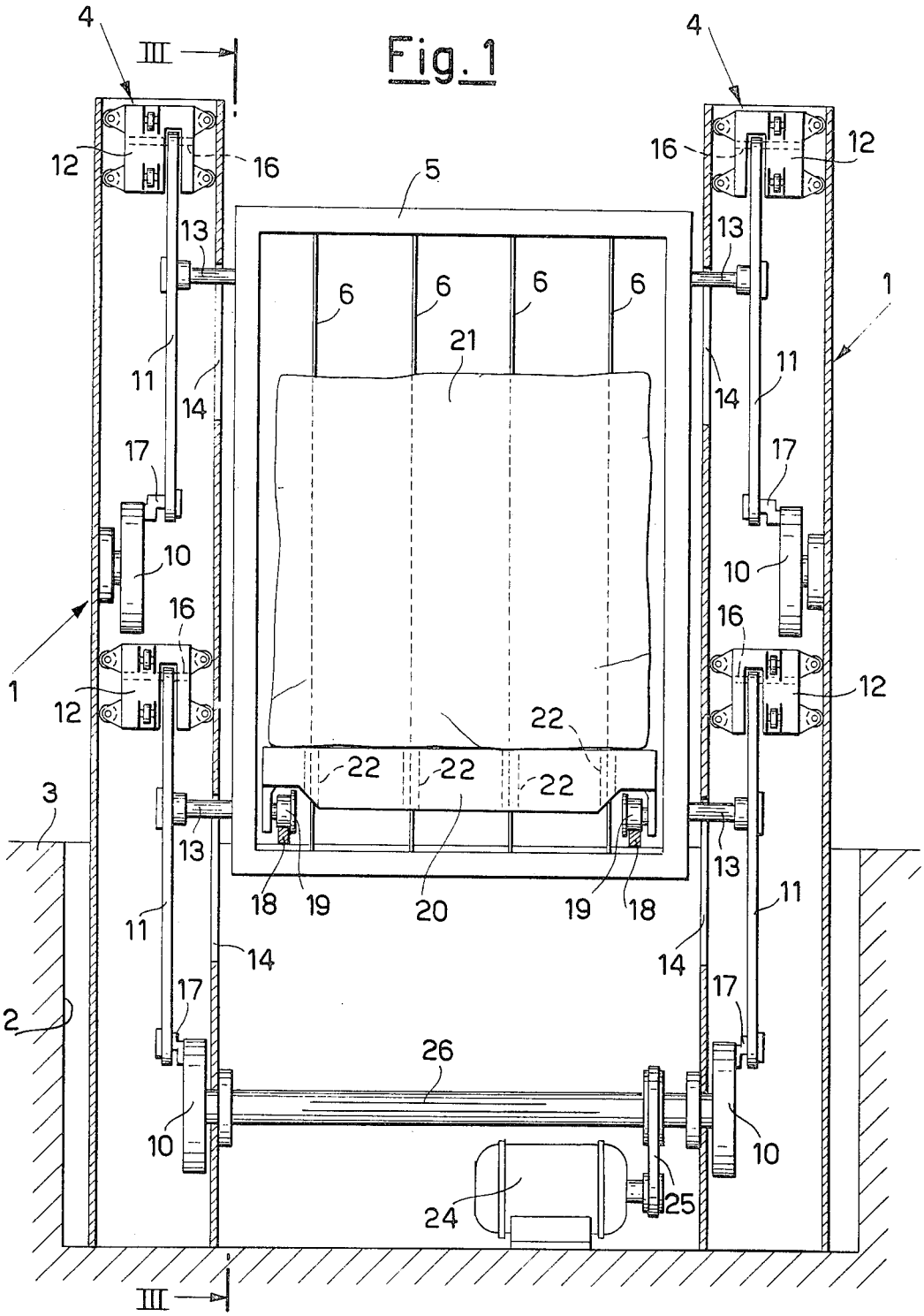
FIG. 1 is an elevational view, partly in cross-section, of a first machine according to the invention for sawing stony materials.
Figure 2:
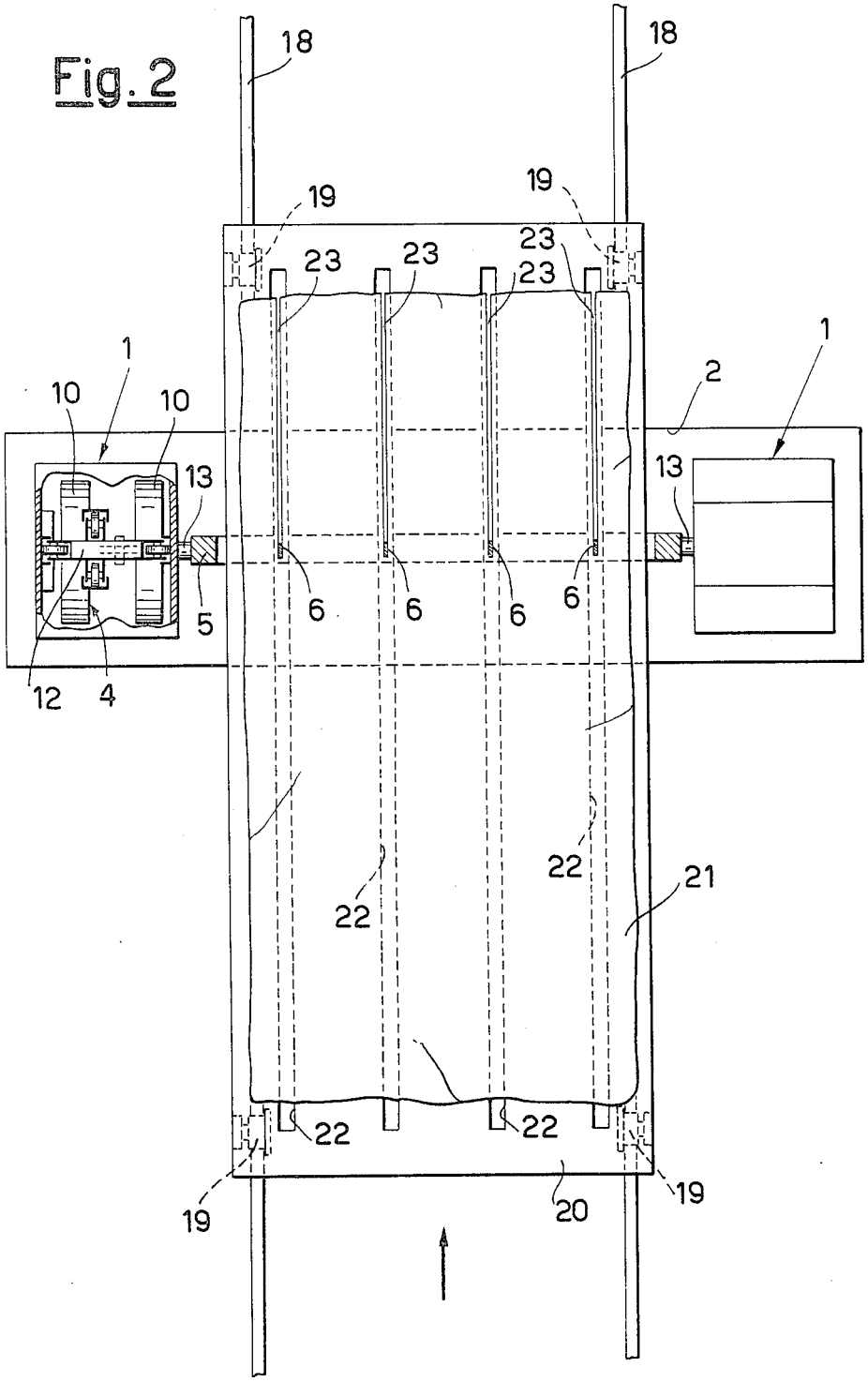
FIG. 2 is a top plan view of the same machine.
Figure 6:
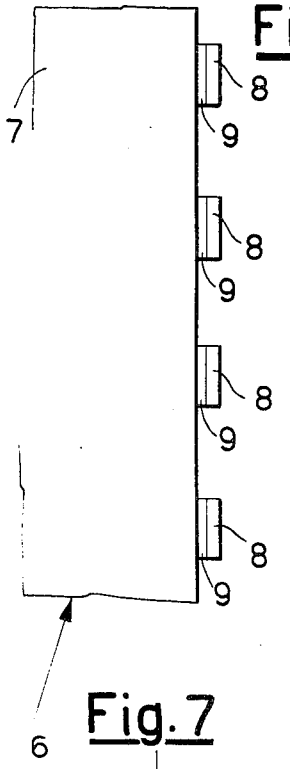
FIG. 6 is a lateral view on an enlarged scale of one of the diamond-lined blades which equip the machine shown in the previous FIGURES.

The machine shown in the FIGS. 1–6, provided especially for the sawing of stony materials, comprises a couple of hollow uprights 1, partially sunk in a hollow space 2 of the ground 3, each upright housing one of the two actuating mechanisms 4 for a frame 5: the latter carries a plurality of parallel blades 6, best seen in FIGS. 1 and 2. As depicted in FIG. 6, each blade is composed by a core 7 of steel, to which is attached a set of spaced apart diamond-lined teeth 8 having a metal bed 9.

Figure 3:
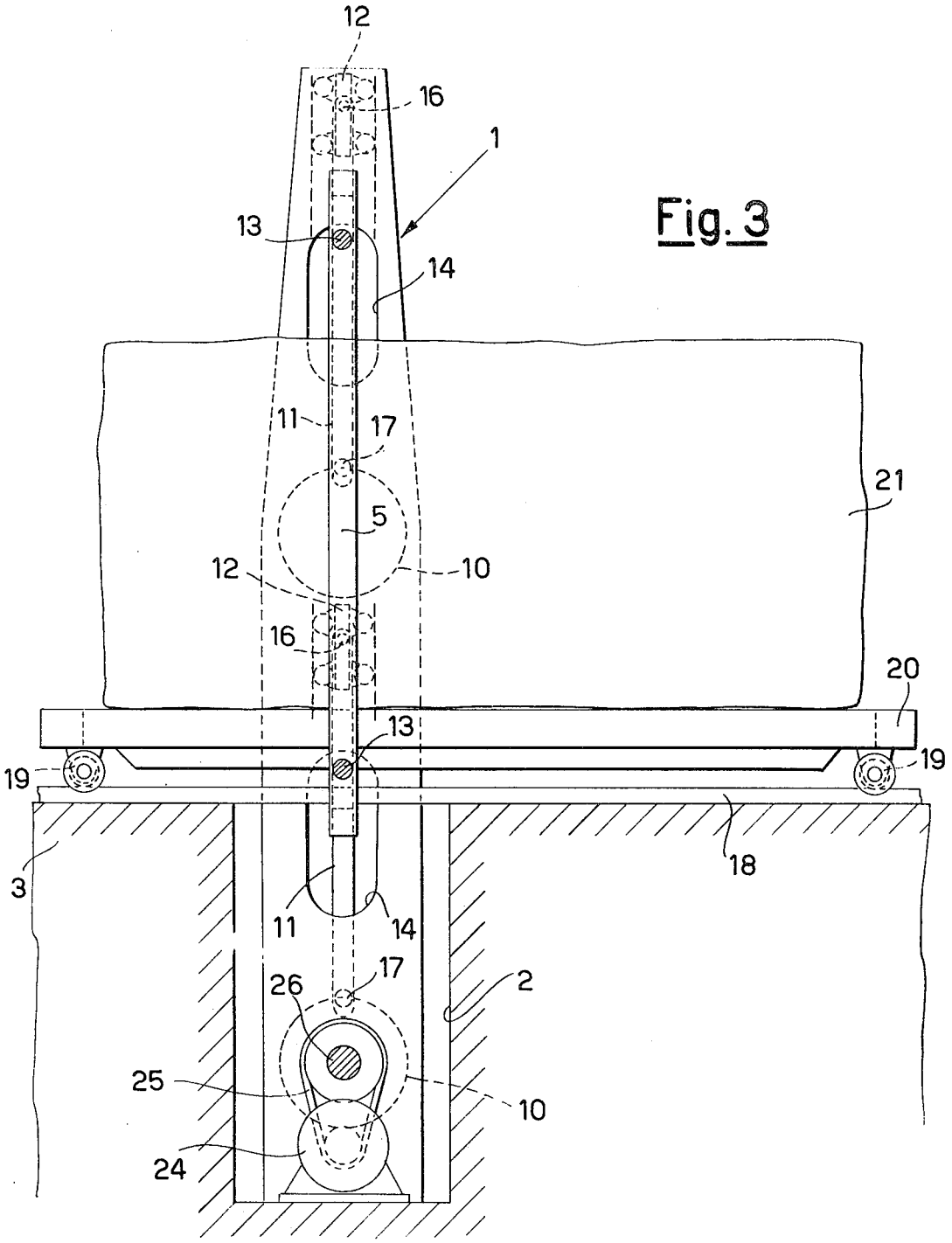
FIG. 3 is a lateral cross-sectional view of the machine, taken along the line III—III of FIG. 1.
Figure 7:
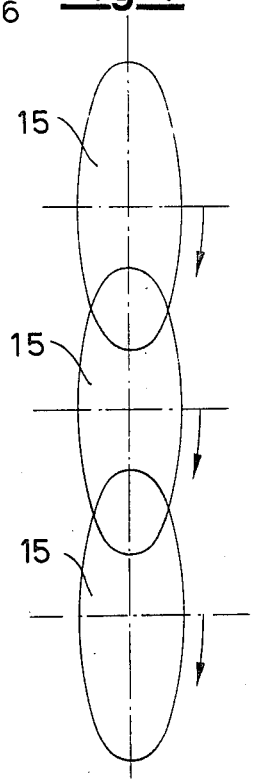
FIG. 7 is a schematic view showing the patterns of the paths followed by the teeth of the blades due to the effect of the motion which has been impressed to the blade-carrying frame by the actuation means shown in FIGS. 3, 4 and 5.
Figure 4:
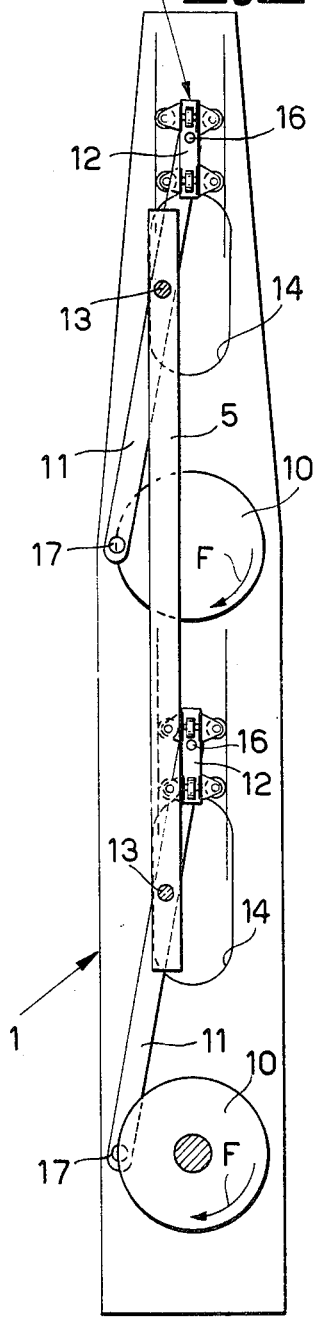
FIGS. 4 and 5 are sectional views showing the respective operative stages, different from that which can be seen in FIG. 3, of the means for actuating the blade-carrying frame of the sawing machine in question.
Figure 5:
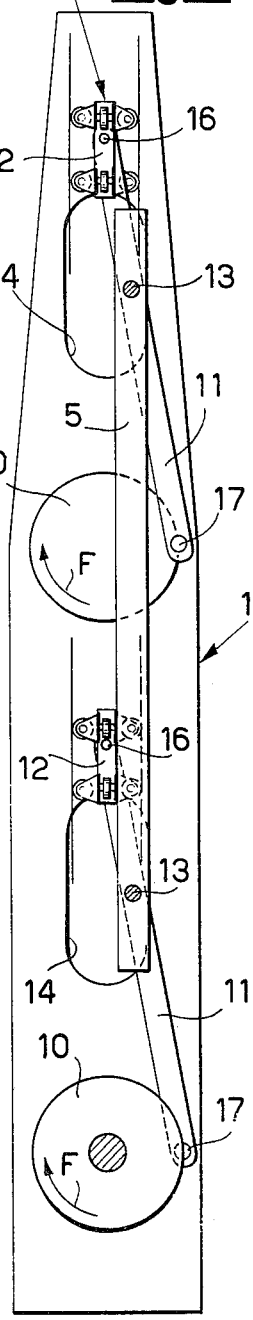

As shown in FIGS. 1 and from 3 to 5, each of the two actuating mechanisms 4 comprises two motive wheels 10 which are equal in size and have a concordant rotary motion imparted thereto by a motor 24 via a belt drive transfer and a shaft 26. To each wheel is attached for rotation at equally eccentric points 17 one end of a respective connecting rod 11 having its other end attached for rotation at 16 to a respective slider 12, the latter being guided to be moved vertically along the connecting line of the axes of rotation of the two motive wheels 10 (FIGS. 3 to 5). To the two connecting rods 11, at points 12, similarly shifted with respect to the ends of such connecting rods, there are attached two of four pins 13 passing through elongate slots 14 of the uprights 1 and securely fastened to the two sides of the blade-carrying frame 5 (FIG. 1). As a result, the continuous rotation in the directions shown by the arrows F in FIGS. 4 and 5, which are concordant, of the two driving wheels 10, imparts an elliptical motion to the frame 5 so that the frame is always disposed parallel to itself, its top dead centre being that shown in FIGS. 1 and 3, and the individual diamond-lined teeth 8 of the individual blades 7 follow, in their turn, elliptical routes such as those shown at 15 in FIG. 7, the axial ratio being greater or smaller consistently with the distances of the pins 13 from the points of attachment of the connecting rods 11 to the sliders 12.

As shown in FIGS. 1, 2 and 3, the blade-carrying frame 5 has, passed therethrough, a couple of fixed rails 18 along which, by the agency of wheels 19, there is caused to roll during the working stage, a carriage 20 which bears the block 21 of stony material to be sawed. In order to allow a free way for the blades 6, the carriage 20 has elongate slits 22 arranged in parallel positions as shown in FIGS. 1 and 2.

By virtue of the combined motions of the carriage 20 and the blade-carrying frame 5, the several blades 6 saw the block 21 of stony material and leave in it furrows 23 having a fixed height and a gradually increasing width. As outlined above, the blades are moved parallel to themselves and follow elliptical routes which, for the individual teeth, have been shown in FIG. 7. These paths provide a forward or working stroke (falling direction) wherein the teeth bite the stone, and saw it, and a return (rising direction) stroke in which the teeth are brought away from the cutting line and a free way is allowed for the washing and cooling water. The degree of withdrawal is a function of the ratio of the major to the minor axis of the elliptical paths, and this, in its turn, is a function of the distance between the pins 13 and the pivotal points 16 of the connecting rods 11 on the sliders 12. As a rule, it will be appropriate to limit the degree of withdrawal since this circumstance is such as to give elongate elliptical lines and thus longer efficient strokes of the teeth in contact with the stone, the result being an improved abrasion effect of the teeth on the material to be sawed.

The machine shown in FIGS. 8 to 12 comprises, in its turn, a couple of hollow uprights 51, each of which houses either of two mechanisms 52 intended to actuate a frame 53, the latter carrying a plurality of parallely arranged blades such as 54.

Each of the two actuating units 52 comprises two wheels 55 and 56 having their axes horizontal, each wheel having pivoted thereto at equally eccentrical points 57 and 58, one end of a respective connecting rod 59, 60. The latter connecting rod has its other end movable along the line which connects the axes of the two wheels 55 and 56 since it is pivoted, at 61, 62, to a small plate 63, 64, to the ends of which is pivoted in turn, at 65, 66 and 67, 68, a respective couple of rods 69, 70 and 71, 72, rotatable about fixed pins 73, 74. To the two connecting rods 59 and 60, and at points homologously situated relative to the connecting rod ends, there are attached two respective pivots 77 and 78 which are passed through vertically elongate slots 81 and 82 of the wall of the upright 51 and reaching either vertical side of the blade-carrying frame 53. The two wheels 55 and 56 are also connected to one another by an additional connecting rod 83 having its ends pivoted to said wheels at points, 92 and 93, which are both diametrically and axially opposite with respect to the pivotal points of the connecting rods 59 and 60. As shown in FIGS. 11 and 12, there can be removably fastened to the connecting rod 83, by means of studs 84 and nuts 85, one or more plates 36 which are adapted to vary the weight of the connecting rod 83.

Figure 8:
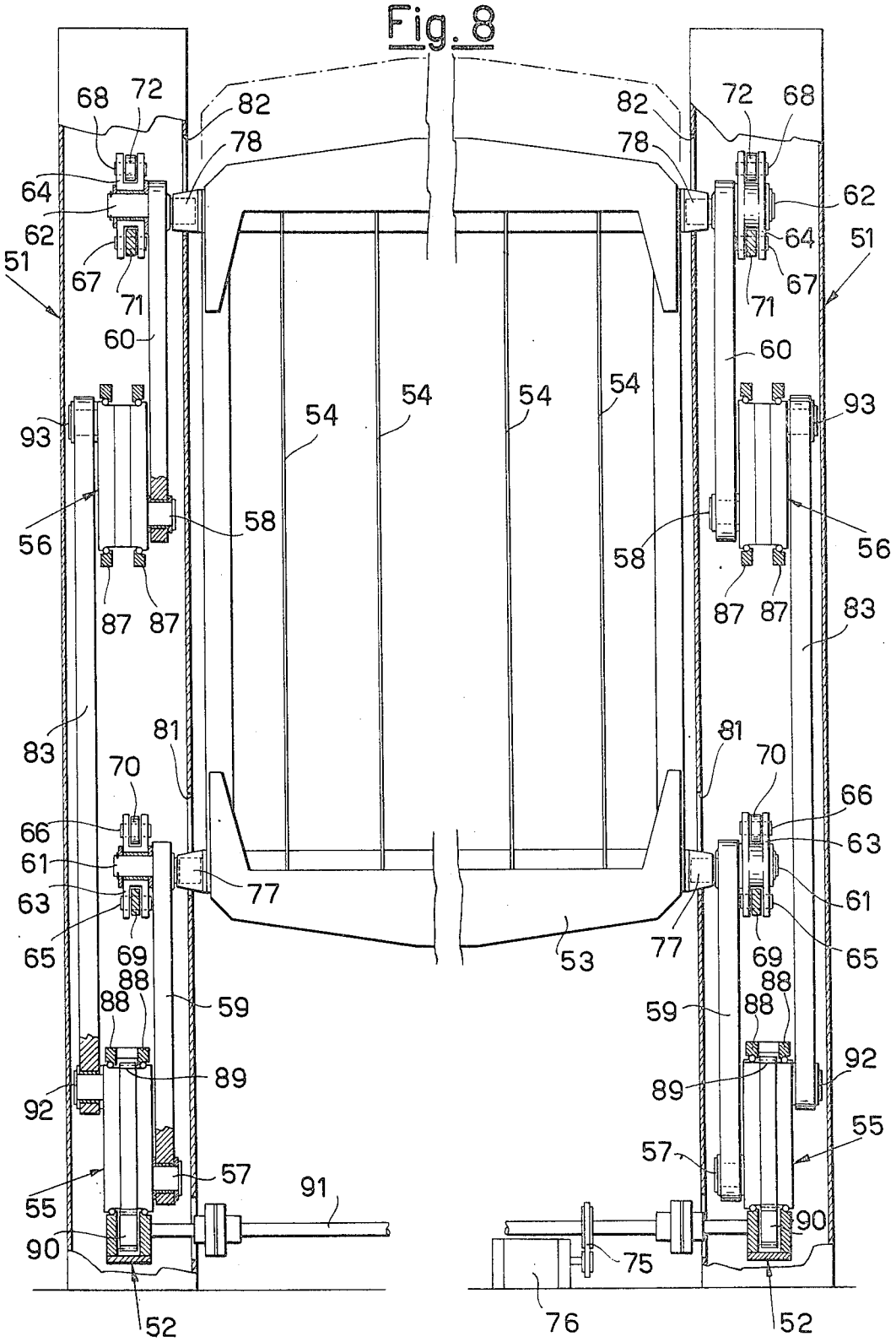
FIG. 8 is an elevational view, partly in cross-section, of a second machine according to the invention and equipped with connecting rods as explained in the foregoing.
Figure 9:
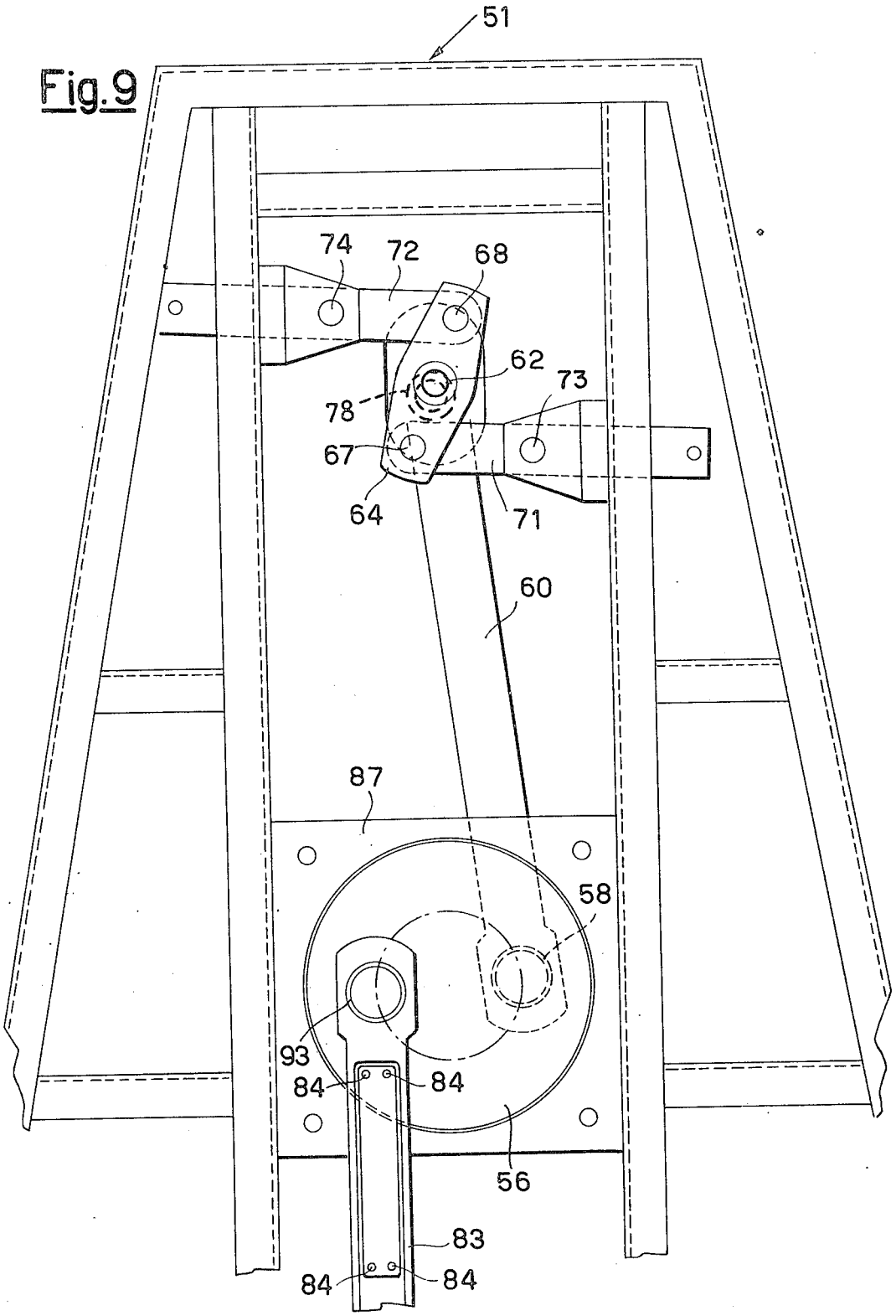
FIG. 9 is an enlarged side view of the top portion of one of the actuating units for the blade-carrying frame contained in the machine of FIG. 8.
Figure 10:
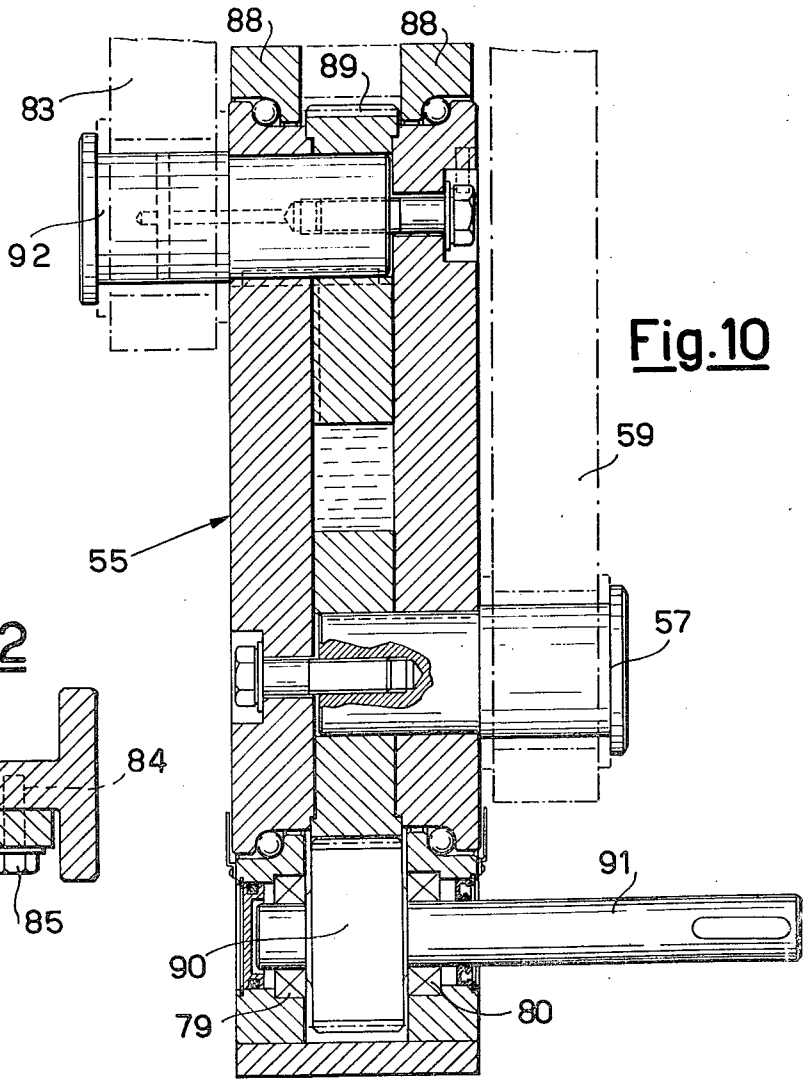
FIG. 10 shows a diametrical cross-sectional view on an enlarged scale of the motive wheel contained in such actuation unit.

For each couple of wheels such as 55 and 56, the bottom wheel 55 is a driving wheel, whereas the top wheel 56 is a driven wheel. As shown in FIGS. 8 and 9, the top wheel 56 is housed in a freely rotatable way in the interior of a double bearing 87, the latter being secured to the upright 51. As shown in FIGS. 8 and 10, the bottom wheel 55, in its turn, is received for rotation in the interior of a double bearing 88 and is equipped with a circumferential ring gear 89 which is in mesh with an underlying pinion 90. This pinion is likewise housed in the interior of the bearing 88 and keyed to a drive shaft 91 borne by bearings 79 and 80. The drive shaft 91, lastly, is driven to rotation by a motor 76 via a belt transfer 75.

The operation of the machine shown in FIGS. 8 to 12, as it is obvious, is similar to that of the machine shown in FIGS. 1 to 6, that is, the drive shaft 91, with the aid of the pinion 90 and the connecting rods 83, originates a concordant rotary motion of the wheels 55 and 56, wherefrom, via the connecting rods 59 and 60, there is originated for the blade-carrying frame 53, an elliptical-path motion in which the frame 53 is constantly maintained parallel to itself and the same is true of the blades 54. In such elliptical motion, the unbalancing mass of the blade-carrying frame 53 is appropriately counteracted by the connecting rods 83, the weight of which can easily be adapted to the variable weight of the frame 53, for example by adding or removing plates such as 86. The machine is thus allowed to attain high working speeds.

The machine shown in FIGS. 13 and 14 comprises, in its turn, a couple of hollow uprights 101, each of which houses one of two mechanisms 102 intended to actuate a frame 103 carrying a plurality of parallely arranged blades 104.

Each of the two actuating units 102 comprises two wheels 105 having horizontal axes, to each wheel being pivoted, at equally eccentrical points 107, one end of a respective connecting rod 110. This rod has its other end movable along the line which unites the axes of the two wheels 105 since the connecting rod 110 is pivoted at 111 to a plate 113: to the ends of 113 is pivoted, at 115 and 118, a respective couple of rods 119 and 121, which are rotatable on fixed pins 116. To the two connecting rods 109, at points which are likewise shifted relative to the connecting rod ends, are attached two respective pins 117 which are passed through vertically elongate slots 120 of the wall of the upright 101 and reaching either of the two vertical sides of the blade-carrying frame 103.

To the two wheels 105 is also attached for rotation, by means of pins 106 situated at points which are both diametrically and axially opposite to those of the pins 107, either end of two balancing connecting rods 108; the other end of which is movable along the line which connects the axes of the wheels 105, since the connecting rod 108 is pivoted at 109 to a plate 112: this plate is very much the same and is secured in the same way to the plate 113. The two balancing connecting rods 108 are exactly equal to the supporting connecting rods 110 and carry respective counterweights 114 weighing one fourth the weight of the blade-carrying frame 103. The counterweights 114 are attached to the connecting rods 108 at distances, from the slidable pins 109, which are equal to the distances existing between the pins 117 of attachment of the blade-carrying frame 103, and the slidable pins 111.

Both of the wheels 105 are supported for rotation by the uprights 101 with the intermediary of respective double support bearings 122. The wheels 105 receive the drive from an endless screw 124 through respective rings gears 123, the screw 124 being supported for rotation by a bearing 129, and from a couple of bevel gears 125, 126 connected to a drive shaft 127: the latter is driven to rotation by a motor 130 via a belt drive-transfer 128.

The operation of the machine depicted in FIGS. 13 and 14 is, as it is obvious, akin to that of the machines described in the foregoing, that is to say that the drive shaft 127, through the bevel gear couples 126, 126, the endless screws 124 and the ring gears 123, generates a concordant rotary motion of the wheels 105. From these latter, through the connecting rods 110, the drive is transferred to the blade-carrying frame 103 which thus receives an elliptical path motion in which the frame itself is always maintained parallel to itself, the same being true of the blades 104. In such an elliptical motion, the unbalancing weight of the blade-carrying frame 103 is properly counteracted by the balancing connecting rods 108: these latter have a weight, and arrangement and a mode of motion such as to generate forces which are exactly equal, and contrary, to those originated by the mass of the blade-carrying frame 103.

In connection with all the exemplary embodiments of the machine as shown in the drawings, it should be noted that all the assembly of mechanical component parts which produces the motion of the blade-carrying frame 103 is capable of making up a compact unit which can be adjusted as to its level along the hollow uprights 1, 51, 101 so as to adjust the positioning of the blade-carrying frame as a function of the thickness of the block of material to be sawed. This circumstance is such as to afford to the machine an advantageous feature according to which, if such a block of material has a reduced thickness, it is possible appropriately to lower the blade-carrying frame in order that only the intermediate-high portion of the blades is set to work, the lower portion of the blades being spared. The result is an even consumption of all the diamond-lined portion of the blades and, that which is much more important, slabs of an even thickness can thus be obtained.

I claim:

1. A machine for sawing blocks of a solid material, more particularly stony materials, said machine comprising a movable frame for supporting a plurality of parallel toothed blades, and frame actuating means for moving said frame along a preselected substantialy elliptical path, said frame actuating means comprise at each side of said blade-carrying frame a pair of wheels having continuous concordant rotary motions around parallel fixed axes, a pair of remote sliders and a pair of connecting rods one end of each of said connecting rods being pivotally eccentrically attached to a respective one of said wheels and the other end of each of said connecting rods being pivotally attached to a respective one of said pair of sliders, means mounting each of said sliders for movement rectilinearly parallel to a line between said axes of the wheels, said connecting rods being of substantially the same length and having a side of said blade-carrying frame pivotally attached thereto at respective points substantially equally spaced from said other end of said connecting rods.

2. A machine according to claim 1, characterized in that each pair of wheels is equipped with an additional liaison connecting rod having its ends pivoted to said wheels at points which are both diametrically and axially opposite relative to the pivotal points of connection of said first-mentioned connecting rods to said wheels.

3. A machine according to claim 2, characterized in that each pair of wheels includes an idle wheel and a driving wheel, the idle wheel being mounted for rotation in the interior of a bearing, and the driving wheel, in its turn, being mounted for rotation in the interior of another bearing and being fitted with a ring gear on its circumferential outline and a pinion also housed in said additional bearing and having a driving shaft, said pinion being meshed with said ring gear.

4. A machine according to claim 1, characterized in that each of said wheels has associated thereto a balancing connecting rod equal to the corresponding supporting connecting rod of the blade-carrying frame and having one end pivoted on said respective wheel at a point which is both diametrically and axially opposite relative to the pivotal point of said one end of said supporting connecting rod and the other end reciprocable in the same direction, but in opposite sense, relative to said other end of the supporting connecting rod, said balancing connecting rod carrying a counterweight weighing one-fourth of the weight of the blade-carrying frame and fastened to said balancing connecting rod at a point situated at a distance from said other end of the balancing connecting rod which is equal to the distance between the point of attachment of the blade-carrying frame and said other end of the supporting connecting rod.

5. A machine according to claim 4, characterized in that each of said wheels is mounted for rotation in the interior of a respective bearing and is circumferentially equipped with a ring gear which emerges from said bearing, and a driving endless screw meshed with each ring gear.

* * * * *

UNITED STATES PATENT AND TRADEMARK OFFICE

CERTIFICATE OF CORRECTION

PATENT NO. : 4,226,223

DATED : October 7, 1980

INVENTOR(S) : Ermanno Pacini

It is certified that error appears in the above-identified patent and that said Letters Patent are hereby corrected as shown below:

In the heading, insert the priority data:

[30] Foreign Application Priority Data

May 15, 1978 [IT] Italy ..... 23423 A/78

Nov. 3, 1978 [IT] Italy ..... 29441 A/78

Signed and Sealed this

Seventh Day of April 1981

[SEAL]

Attest:

RENE D. TEGTMEYER

Attesting Officer

Acting Commissioner of Patents and Trademarks